US008001794B2

(12) United States Patent
Windisch

(10) Patent No.: US 8,001,794 B2
(45) Date of Patent: Aug. 23, 2011

(54) THERMOELECTRIC FLUID HEAT EXCHANGE SYSTEM

(75) Inventor: Robert Windisch, Melbourne, FL (US)

(73) Assignee: Action Circuit Productions, Inc., Satellite Beach, FL (US)

( * ) Notice: Subject to any disclaimer, the term of this patent is extended or adjusted under 35 U.S.C. 154(b) by 0 days.

(21) Appl. No.: 11/679,103

(22) Filed: Feb. 26, 2007

(65) Prior Publication Data

US 2007/0199333 A1 Aug. 30, 2007

Related U.S. Application Data

(60) Provisional application No. 60/777,301, filed on Feb. 27, 2006.

(51) Int. Cl.
*F25B 21/02* (2006.01)

(52) U.S. Cl. ..... 62/3.5; 62/259.3

(58) Field of Classification Search ..... 62/3.2, 62/3.3, 3.5, 259.3
See application file for complete search history.

(56) References Cited

U.S. PATENT DOCUMENTS 5,092,129 A * 3/1992 Bayes et al. ..... 62/3.3
5,197,294 A * 3/1993 Galvan et al. ..... 62/3.62
5,584,183 A 12/1996 Wright et al.
5,899,077 A 5/1999 Wright et al.
6,032,726 A 3/2000 Wright et al.
6,311,497 B1 * 11/2001 Chung ..... 62/3.3
6,354,002 B1 3/2002 Wright et al.
6,427,449 B1 8/2002 Logan et al.
6,619,044 B2 * 9/2003 Batchelor et al. ..... 62/3.3
6,676,024 B1 1/2004 McNerney et al.
2003/0098143 A1 5/2003 Winkle
2003/0116869 A1 6/2003 Siu

FOREIGN PATENT DOCUMENTS

WO 2004027295 1/2004

* cited by examiner

*Primary Examiner* — Melvin Jones
(74) *Attorney, Agent, or Firm* — Fulbright & Jaworski L.L.P.

(57) ABSTRACT

A thermoelectric heat exchange system for fluids comprising a pumping device, configured to deliver a fluid; a fluid inlet system in fluid communication with the pumping device; a fluid outlet system in fluid communication with the pumping device; a reservoir in fluid communication with the pumping device, and configured to hold a fluid; and a heat exchange system in fluid communication with the fluid delivery system, including: a heat exchange plate in fluid communication with the fluid system, comprising a channel system wherein the width of the channel system is about an order of magnitude greater than the depth of the channel system; a thermoelectric cooling module in thermal communication with the heat exchange plate; and a heat sink in communication with the thermoelectric cooling module, and configured to dissipate heat from the thermoelectric cooling module.

20 Claims, 9 Drawing Sheets

THERMOELECTRIC FLUID HEAT EXCHANGE SYSTEM

CROSS-REFERENCE TO RELATED APPLICATIONS

This invention claims priority, under 35 U.S.C. § 120, to the U.S. Provisional Patent Application No. 60/777,301 filed on Feb. 27, 2006, which is incorporated by reference herein.

BACKGROUND OF THE INVENTION

1. Field of the Invention

The present invention relates to fluid heat exchange devices and systems, specifically to a fluid thermoelectric heat exchange system adaptable for a variety of uses.

2. Description of the Related Art

Heating and cooling devices and systems provide an invaluable tool for modifying and controlling the temperature of a person, a room, a home, a building, a car, etc. Indeed, heating and cooling devices and systems may be used to control and modify the temperature of any enclosed area or person. For example, military personnel or other persons fighting or working in harsh desert or cold arctic climates.

In the related art, heat exchange devices and systems have often been used to control and modify the temperature of fluids running through a system. Heat exchange systems and devices enable the heating and/or cooling of fluids without major inputs of excess amounts of energy. However, these systems have often been complex, not very efficient, very bulky, not easily stored, and not very energy efficient. With the introduction of Peltier devices, utilizing peltier junctions and/or the Peltier Effect, the efficiency and marketability of heat exchange systems has increased.

Some improvements have been made in the field. Examples include but are not limited to the references described below, which references are incorporated by reference herein:

U.S. Pat. No. 6,676,024, issued to McNerney et al., discloses a thermostatic valve controlled by a motor that receives signals from an electronic control module (ECM). The ECM sends an electric signal corresponding to a desired outlet stream temperature to the motor, which turns the thermostatic valve to a location corresponding to the desired temperature. The ECM also adapts the thermostatic valve capacity to outlet flow demands by restricting and opening inlet valves, ensuring that the thermostatic valve can maintain an equilibrium temperature for both high and low outlet flow applications.

U.S. Pat. No. 5,899,077, issued to Wright et al., discloses a novel thermoelectric liquid heat exchange device for corrosive or high purity liquids is provided for. The heat exchange device has an array of thermoelectric modules, with first and second heat exchanger plates arranged so as to sandwich the thermoelectric modules between the heat exchanger plates. One of the heat exchanger plates has a thermally conductive metal base plate, plastic tubing and a cover plate. The base plate has a flat side contacting the thermoelectric modules, and an opposing side with grooves of a pre-selected depth. The plastic tubing has a diameter to match the depth of the grooves so that the tubing engages the grooves. The cover plate is fastened to the base plate and over the plastic tubing in the grooves of the base plate to press the tubing into the grooves to improve thermal contact between the plastic tubing and the base plate. The plastic tubing carries the corrosive or high purity liquids for heating or cooling by the operation of the thermoelectric modules and the other heat exchanger plate.

U.S. Patent Application Publication No.: 2003/0116869, by Siu, Wing Ming, discloses a split-body Peltier device includes a plurality of thermoelectric junctions having dissimilar metallic conductors that are functionally interconnected in series and/or parallel by metallic conductors that may be identical to the junction materials. By using these metallic conductors, interconnection electrical resistance is reduced to allow a significant separation between the hot junction and the cold junction without dramatically increasing the ohmic heating. Further, the relatively small area-to-length ratio of the interconnecting material promotes heat loss along its length that effectively prevents heat at the hot junction from reaching the cold junction through the interconnecting material via conduction, thereby substantially eliminating Thermal Back Diffusion and accommodating auxiliary cooling devices to improve the device performance.

U.S. Patent Application Publication No.: 2003/0098143, by Winkle, discloses a fluid heat exchanger assembly comprising: a fluid inlet; a cooler fluid conduit in fluid communication with the fluid inlet having a cooler fluid outlet; a warmer fluid conduit in fluid communication with the fluid inlet and having a warmer fluid outlet; and at least one ceramic wafered thermoelectric device having a cooling wafer surface and an opposed warming wafer surface, positioned between the warmer fluid conduit and the cooler fluid conduit, such that the cooling wafer surface faces the cooler fluid conduit and the warmer wafer surface faces the warmer fluid conduit; whereupon electrical activation of the ceramic wafered thermoelectric device the cooling wafer becomes relatively cool in comparison to the warmer wafer surface becoming relatively warm. Additionally, the heat exchanger assembly may receive ambient air flowing through a fluid inlet positioned within or on a vehicle such that the cooler fluid is directed into at least one item taken from the group of: a body-suit worn by a driver of a vehicle, apparel worn by a driver of a vehicle and protective equipment worn by a driver of a vehicle.

International Patent Application Publication No. WO 2004/027295, discloses a fluid mixing valve for producing a mixed fluid stream from the first and second inlet fluid streams having different, varying temperatures, and having different, varying pressures, the mixed fluid having a substantially stable, pre-selected temperature of a magnitude between the temperatures of the first and second inlet fluid streams, the fluid mixing valve including a housing and a mixing regulation assembly disposed within the housing. The invention also provides a method for producing a mixed fluid stream from first and second inlet fluid streams having different, varying temperatures, and having different varying pressures, the mixed fluid stream having a substantially stable pre-selected temperature of a magnitude between the temperatures of the first and second fluid streams.

The inventions heretofore known suffer from a number of disadvantages which include: not being efficient, requiring substantial energy inputs, having expensive and/or complicated components, being bulky and/or not easy to store, having inadequate and/or complicated temperature controls, being limited in use and adaptability, and/or being difficult and/or expensive to manufacture.

What is needed is a thermoelectric heat exchange system for fluids that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available thermoelectric heat exchange systems. Accordingly, the present invention has been developed to provide a thermoelectric heat exchange system which is energy efficient, enables a user to adjust and/or control the temperature of the fluid, maximizes the exchange and/or dissipation of heat from the system, and/or is compact and easy to operate and store. Further, the present invention provides a heat exchange system adaptable to a variety of different uses and/or objects, such as vehicles, motorcycles, persons, area, etc.

In one embodiment, there is a thermo electric heat exchange system for fluids which may comprise: a fluid delivery system and/or a heat exchange system. The fluid delivery system may include: a pumping device, configured to deliver a fluid; a fluid inlet system in fluid communication with the pumping device; a fluid outlet system in fluid communication with the pumping device; and/or a reservoir in fluid communication with the pumping device, and/or configured to hold a fluid. The heat exchange system may be in fluid communication with the fluid delivery system and may include: a heat exchange plate in fluid communication with the fluid system, comprising a channel system; a thermoelectric cooling module in thermal communication with the heat exchange plate; and/or a heat sink in communication with the thermoelectric cooling module, and configured to dissipate heat from the thermoelectric cooling module.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). Understanding that these drawing(s) depict only typical embodiments of the invention and are not therefore to be considered to be limiting of its scope, the invention will be described and explained with additional specificity and detail through the use of the accompanying drawing(s), in which.

DETAILED DESCRIPTION OF THE INVENTION

Figure 1:
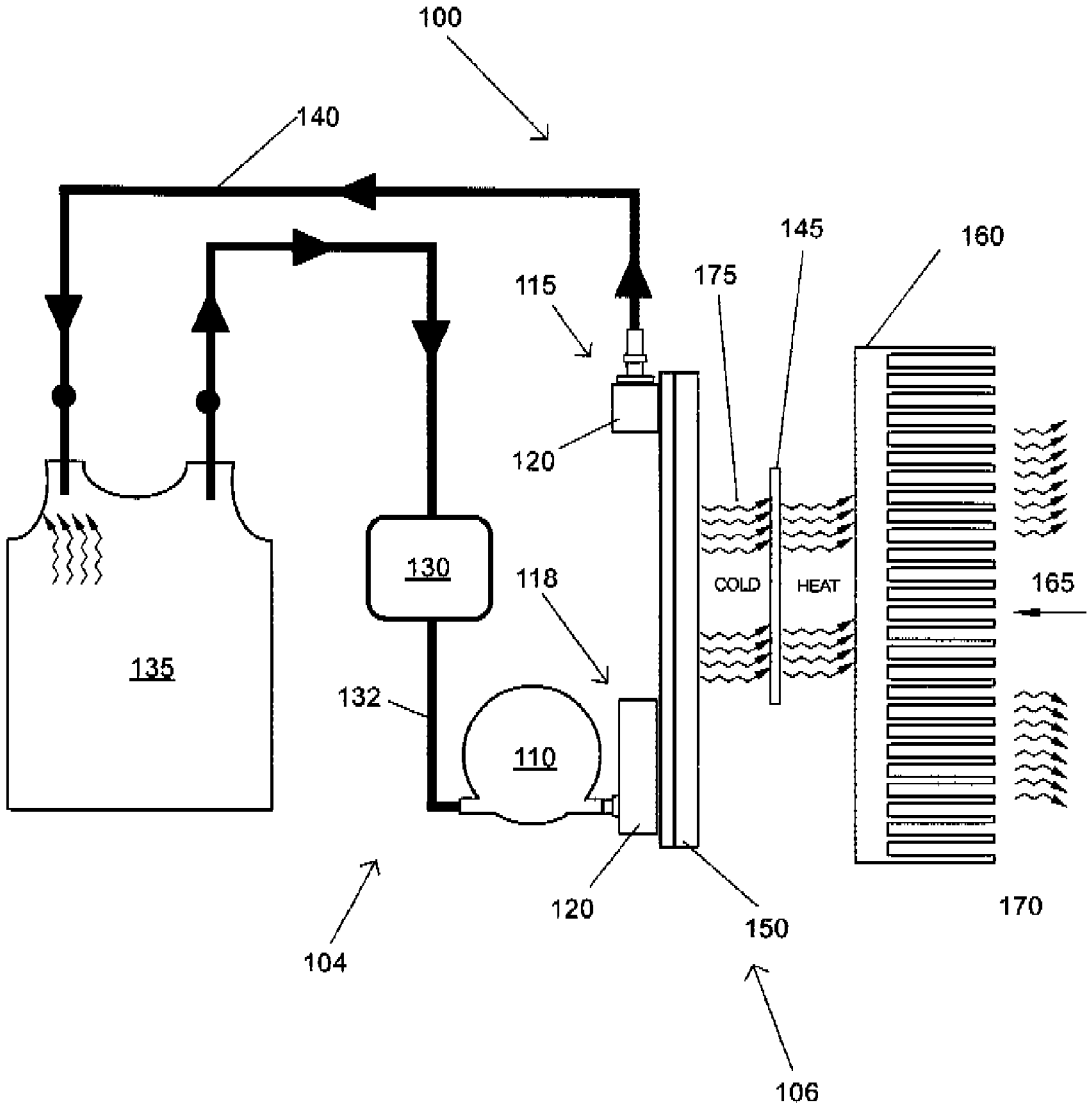
FIG. 1 is a flow diagram of a thermoelectric heat exchange system according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

Typically, heat exchange systems and devices utilize the circulation of fluids inside a tubing system. These heat exchange systems and devices use heat exchanging components such as thermoelectric cooling modules, heat sinks, fans, high thermally conductive materials and the like to dissipate the heat energy from the fluid. In typical tubing systems however, circulating fluid may develop laminar flow on the inner portions of the tubing and channel systems. Laminar flow may be described as a boundary that can build up from friction between channel and/or tubing walls and the water molecules. This layer substantially decreases the efficiency of the heat exchange. To counteract these inefficiencies, the fluid in the system may be circulated at a higher velocity, more current may be run through the thermoelectric cooling module, and/or the heat exchange system may be operated for a longer period of time. As indicated, however, counteracting these inefficiencies requires a substantial amount of more time and energy input into the heat exchange system and device.

A Peltier device and/or junctions are reversible thermoelectric conversion devices that utilize the Peltier effect. The Peltier effect is the heating of one junction and the cooling of an associated second junction when an electric current is maintained in junctions having two dissimilar conductors. That is, when the electric current passes through a junction of two dissimilar materials, heat is either absorbed or released depending on the direction of the electric current through the junction. Since an electric current must be closed in order to ensure a continuous current, in any closed circuit, both cooling (cold) and heating (hot) junctions exist. Thus, the presence of the electric current merely moves the heat from one place to another, and as such, a Peltier device is really a heat pump that can be used in heating and cooling applications. The Peltier device can also be operated in reverse so that by maintaining a temperature difference between the hot and cold junctions an electric current can be generated.

The Peltier effect is related to the difference of the Peltier coefficients of the two dissimilar materials that from the junction. These are often referred to as the junction materials. In general, the larger the difference in the Peltier coefficients, the larger the Peltier effect, and the better the resulting cooling or power generation performance. However, the Peltier effect is also offset by the ohmic heating due to the flow of electric current through the junction materials and the heat diffusing from the hot junction back toward the cold junction (Thermal Back Diffusion). This balance between the Peltier effect, the ohmic heating, and the Thermal Back Diffusion is represented by the Figure of Merit (Z), which is used in the industry as a means of evaluating the appropriateness of different materials to form the junction in a Peltier device. Generally, materials with a maximum Z are sought due to their low thermal conductivity and large Peltier coefficients, semiconductors are typically the material of choice for Peltier devices, such as bismuth telluride. Much research on Peltier devices is directed toward developing new semiconductor materials with increased Z. However, when using semiconductors as the junction materials the electric resistance, and thus the ohmic heating, can become very large. Although this ohmic heating can be minimized by using superconductors as the junction materials, the necessary cryogenic cooling is rarely either feasible or practical for most conventional thermoelectric applications. Thus, for junctions made out of semiconductors, the ohmic heating is typically managed by reducing the length-to-area ratio of the junction material, thereby decreasing the separation distance between the hot and cold junctions, which tends to increase the Thermal Back Diffusion effect.

Thermal Back Diffusion limits the performance of the current generation of Peltier devices. For power generation applications, it comprises the temperature difference that can be maintained between the hot and cold junctions, and for cooling applications, it compromises the cooling process at the cold junction. One method of managing the Thermal Back Diffusion effect is to increase the thermal insulation between the hot and cold junctions without significantly increasing the electrical resistance. This is, in fact, one direction being pursued in the development of new Peltier devices, but the rate of these developments has been unable to keep up with the growing demand for improved performance.

Another method, particularly for cooling applications, is to minimize the temperature difference across the hot and cold junctions, by increasing the rate and efficiency of the heat removal process at the hot junction. There have been numerous efforts to address this heat removal process at the hot junction. Although there has been a focus on improving heat removal at the hot junction, there has not been a focus on the thermal path between the hot and cold junctions. As a result, the effectiveness of the various techniques disclosed for managing the Thermal Back Diffusion remained dependent on the cooling rate that could be achieved at the hot junction.

Without explicitly removing the thermal path, the potential still exists for the heat to back-diffuse from the hot junction toward the cold junction. The difference is that with the more efficient heat-removal at the hot junction, the existing Peltier devices can now cool to a higher level before the onset of thermal back-diffusion. For example, there is a limit to the heat flux that can be removed by force convection, and thus for cooling rate requirements above a certain level, neither the heat pipe nor the fin-fan convective systems would be adequate to prevent Thermal Back Diffusion.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

Additionally, many of the functional units, hardware, components, and/or modules herein are described as being "in communication" with other functional units, hardware, components, and/or modules. Being "in communication" refers to any manner and/or way in which functional units, hardware, components, and/or modules, such as, but not limited to, tubing, nozzles, wires, reservoirs, pumps, heat sinks, clothing, and other types of hardware and/or mechanical devices, may be in communication with each other. Some non-limiting examples include communicating, transfer and/or sending, and/or receiving data, electric signals, fluid, power, energy, and/or electric current via: pipes, tubing, containers, heat sink, air, fans, heat, cold air, metals and/or other conductive/non conductive elements, electronic and/or other types of circuitry, instructions, circuitry, satellite signals, electric signals, electrical and magnetic fields and/or pulses, and/or so forth.

As shown in FIG. 1, the thermoelectric heat exchange system 100 for fluids includes a fluid delivery system 104 and a heat exchange system 106 in fluid and/or thermal communication with the fluid delivery system 104. The fluid delivery system 104 may be in fluid and/or thermal communication with the heat exchange system 106 in any manner contemplated in the art, or as described herein. In one non-limiting example, the fluid delivery system 104 is in fluid communication with the heat exchange system 106 via one or more channel systems such as, but not limited to: channels, conduits, tubing and/or piping systems. The channel systems include the use of piping or tubing accessories such as plastic, rubber, and/or, steel. Alternatively, the channel systems may be machined and/or bored into a manifold block; thus, eliminating the need for plastic, rubber, and/or other components.

Also shown in throughout the figures, the fluid delivery system 104 includes: a pumping device 110, configured to deliver a fluid; a fluid inlet system 118 in fluid communication with the pumping device 110; a fluid outlet system 115 in fluid communication with the pumping device 110; and a reservoir 130 in fluid communication with the pumping device 100, and configured to hold a fluid. The pumping device 110 may be any type and/or kind of pumping device contemplated in the art. Some non-limiting examples of pumping device include: positive displacement pumps, centrifugal pump, jet pumps, peripheral pumps, gas lift pumps, condensate pumps, diaphragm pumps, engine driven pumps, and/or so forth. Indeed, there may be a plurality of pumping devices 110 included in the fluid delivery system 104.

Additionally, as shown in figures, the fluid delivery system 104 includes a fluid outlet system 115 in fluid communication with the pumping device 110. The fluid outlet system 115 may comprise any components, hardware, systems, etc. contemplated in the art which assist and/or function to transfer fluid out of the thermoelectric heat exchange system 100. In one non-limiting example, the fluid outlet system 115 includes a nozzle 115 configured to outlet fluid from the thermoelectric heat exchange system 100. The nozzle 115 may be any type of nozzle contemplated in the art. Some non-limiting examples of nozzles include: brass nozzles, thermoplastic nozzles, hose nozzles, and/or so forth.

Also shown in the figures, the fluid delivery system 104 includes a fluid inlet system 118. The fluid inlet system 118 may comprise any components, hardware, systems, etc. contemplated in the art which assist and/or function to transfer fluid into the thermoelectric heat exchange system 100. In a non-limiting example, the fluid inlet system 118 comprises a nozzle 118 and/or other components which may be substantially identical to the fluid outlet system 115.

In one embodiment, the fluid delivery system 104 includes one or more series of channels, tubes, pipes, or other fluid transfer mediums 132,140 removably coupled to the fluid inlet system 118 and/or the fluid outlet system 115, and configured to transfer a fluid. In one non-limiting example, a first end portion 140 of a channel/tubing system 132,140 is removably coupled to the fluid outlet system 115, and the opposing end portion 132 of the channel/tubing system is removably coupled to the fluid inlet system 118; such that a fluid flowing out of the thermoelectric heat exchange system 100 through the fluid outlet system 115, circulates through the channel/tubing system 132, 140 and flows through the fluid inlet system 118 back in to the thermoelectric heat exchange system 100. The channel/tubing system 132, 140 may be used, formed, setup, and/or engineered to circulate the fluid through any garment, object, system hardware, and/or area 135 and then circulate the fluid back through the thermoelectric heat exchange system 100. The channel/tubing system 132, 140 may include gaskets, seals, and/or washers configured to prevent leakage of a fluid and/or pressure from the system 100. The channel/tubing system 132,140 may be insulated and/or comprise an insulating layer as to prevent thermal energy loss from the channel/tubing system 132, 140.

Illustrated in the figures, the fluid delivery system 104 includes a reservoir 130 in fluid communication with the pumping device 110. The reservoir 130 may be any type and/or kind of reservoir and/or container configured to contain a fluid. The reservoir may also include a filler tube and/or system 250 configured to enable a fluid to be poured and/or placed into the reservoir 130. Additionally, the reservoir 130 may function to maintain the level of a fluid in the thermoelectric heat exchange system 100. The reservoir 130 may be composed of any material contemplated in the art, such as but not limited to, metal, plastic, polyurethane, and/or so forth. In one non-limiting the reservoir 130 may be machined and/or bored into the manifold block and/or system 120; thereby not necessitating the use of additional components and/or reservoir parts.

Additionally, as illustrated in the figures, the thermoelectric heat exchange system 100 includes a heat exchange system 106 in communication with the fluid delivery system 104. In one non-limiting example, the heat exchange system 106 is in fluid communication with the fluid delivery system 104.

Shown in throughout the figures, the heat exchange system 106 includes a heat exchange plate 150 and a heat exchange plate cover 450 in fluid communication with the fluid delivery system 104. The heat exchange plate 150 and the heat exchange plate cover 450 may comprise and/or be composed of any material contemplated in the art. In a non-limiting example, the heat exchange plate 150 and the heat exchange plate cover 450 comprise a pair of substantially planar plates which may be composed of the any type of thermally and/or electrically conductive material and/or element contemplated in the art. Some non-limiting examples of thermally conductive material include: aluminum, aluminum alloys, steel, metal alloys, and/or so forth.

In one embodiment, as illustrated in FIGS. 5 through 8, the heat exchange plate 150 and the heat exchange plate cover 450 comprises a channel system 410 in fluid communication with the fluid delivery system 104. The channel system 410 may include a series of substantially shallow channels. In being substantially shallow, the channel system 410 may include a width 610 that is about and/or at least three times greater than the depth 320. The width 610 being about and/or at least three times greater than the depth 620 may be defined as the width being at least two point eight times greater, three times greater, four times greater, six times greater, seven times greater, eight times greater, and/or at least ten times greater than the depth 620. The width 610 is further illustrated in FIGS. 5 through 8 as being parallel to the longitudinal axis of the heat exchange plate 150. The longitudinal axis being indicated by the cross sectional marking in FIGS. 5 through 8. It is believed that the shallow depth of the channel system 410 advantageously prevents the accumulation of fluid buildup and/or laminar flow around the channel system 410. Accordingly, the efficiency of the heat exchange process and system is greatly increased without the need for extra energy or time input into the system 100.

In an additional embodiment, the channel system 410 may be configured to have substantially the same cross sectional area of the fluid delivery system 104. In being substantially the same cross sectional area, the channel system 410 may or may not have a cross sectional area equal to the fluid delivery system 104. Indeed, there may be up to about a ten percent, twelve percent, nine percent, seven percent, and/or four percent difference between the cross sectional areas of the fluid delivery system 104 and the channel system 410.

In another embodiment, as shown in throughout the figures, the channel system 410 is machined into the heat exchange plate 150. Advantageously, being machined into the heat exchange plate 150, the channel system 410 does not require conventional components and materials which can be expensive, necessitate repair and/or replacement, and most importantly, lower the efficiency and/or amount of heat exchange. The channel system 410 may be configured and/or oriented as part of the heat exchange plate 150 such that the maximum amount of surface area is used in the heat exchange plate 150. Indeed, the channel system 410 may be oriented and/or machined into the heat exchange plate 150 in any manner contemplated in the art.

In one non-limiting example, as demonstrated in FIGS. 5 through 8, the channel system 410 is oriented and machined into the heat exchange plate 150 in a series of straight and parallel segments with U-shaped segments at each end forming a serpentine-like pattern. Additionally, the channel system 410 may be arranged in a serpentine or curving pattern. Once machined into the heat exchange plate 150, the heat exchange plate cover 450 may be oriented and sealed against the heat exchange plate 150; thereby completing the formation of the channel system 410. Oriented in this manner, the channel system 410 may provide a maximum amount of surface area for heat and energy exchange; thereby increasing the amount of energy transfer and efficiency of the thermoelectric heat exchange system 100.

Figure 7:
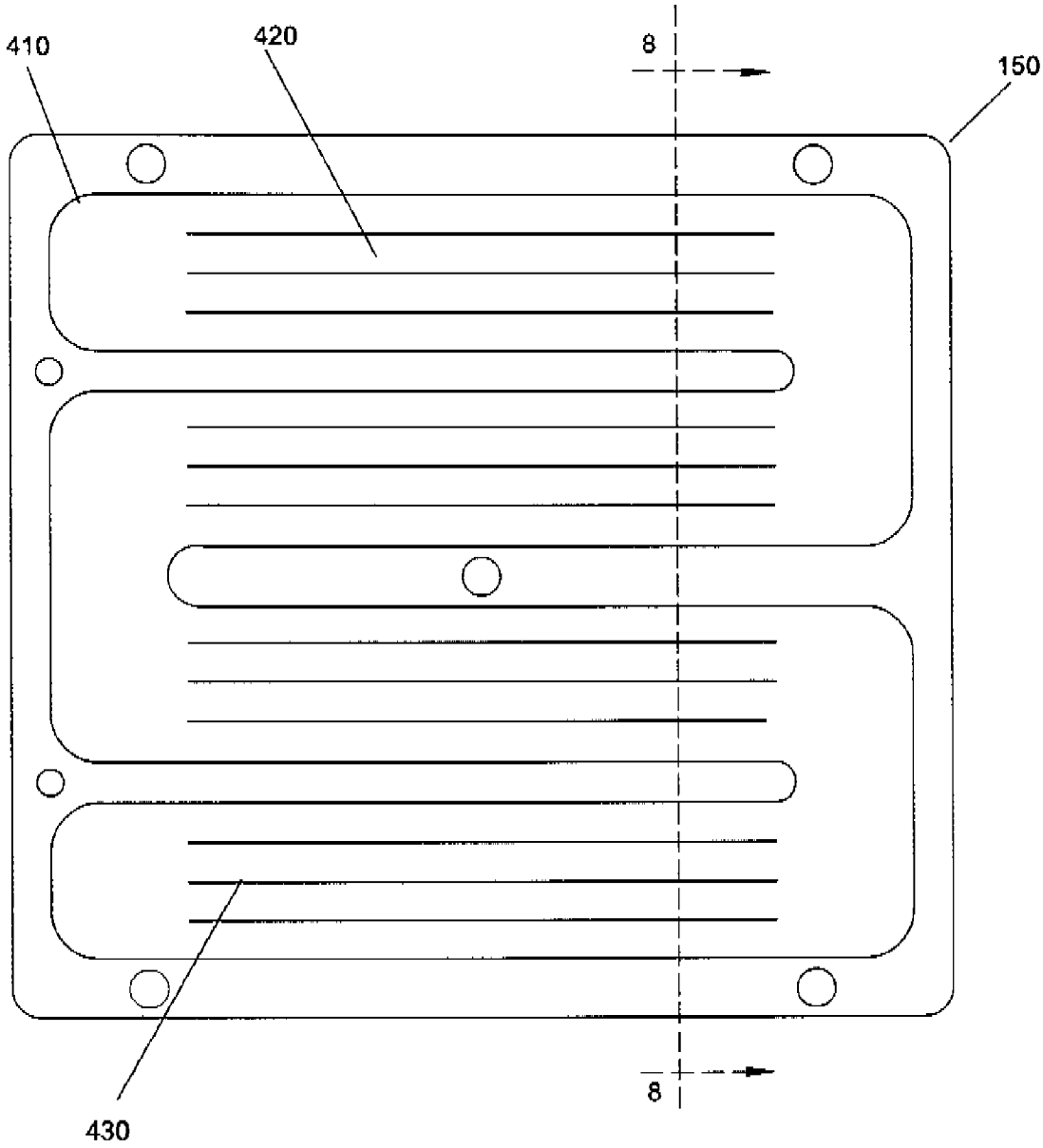
FIG. 7 a front plan view of a heat exchange plate illustrating a longitudinal axis according to one embodiment of the invention.
Figure 8:
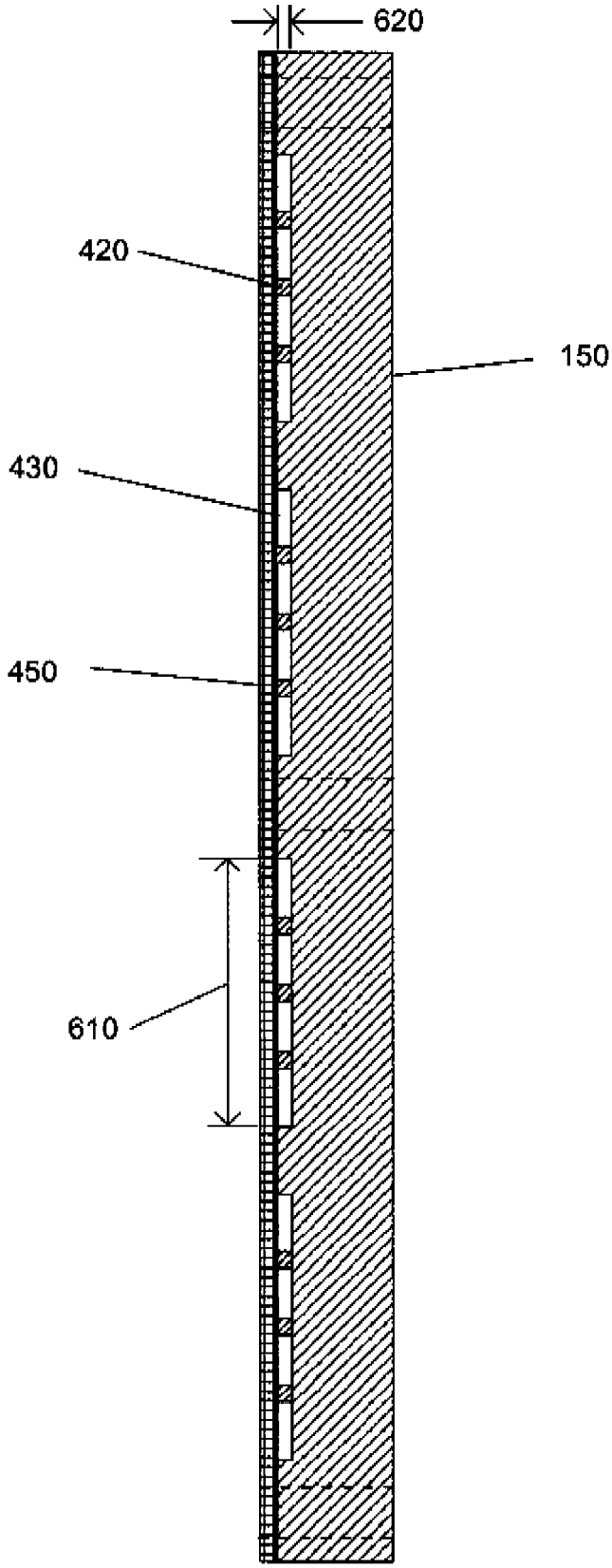
FIG. 8 is a cross sectional view of a heat exchange plate according to one embodiment of the invention.
Figure 9:
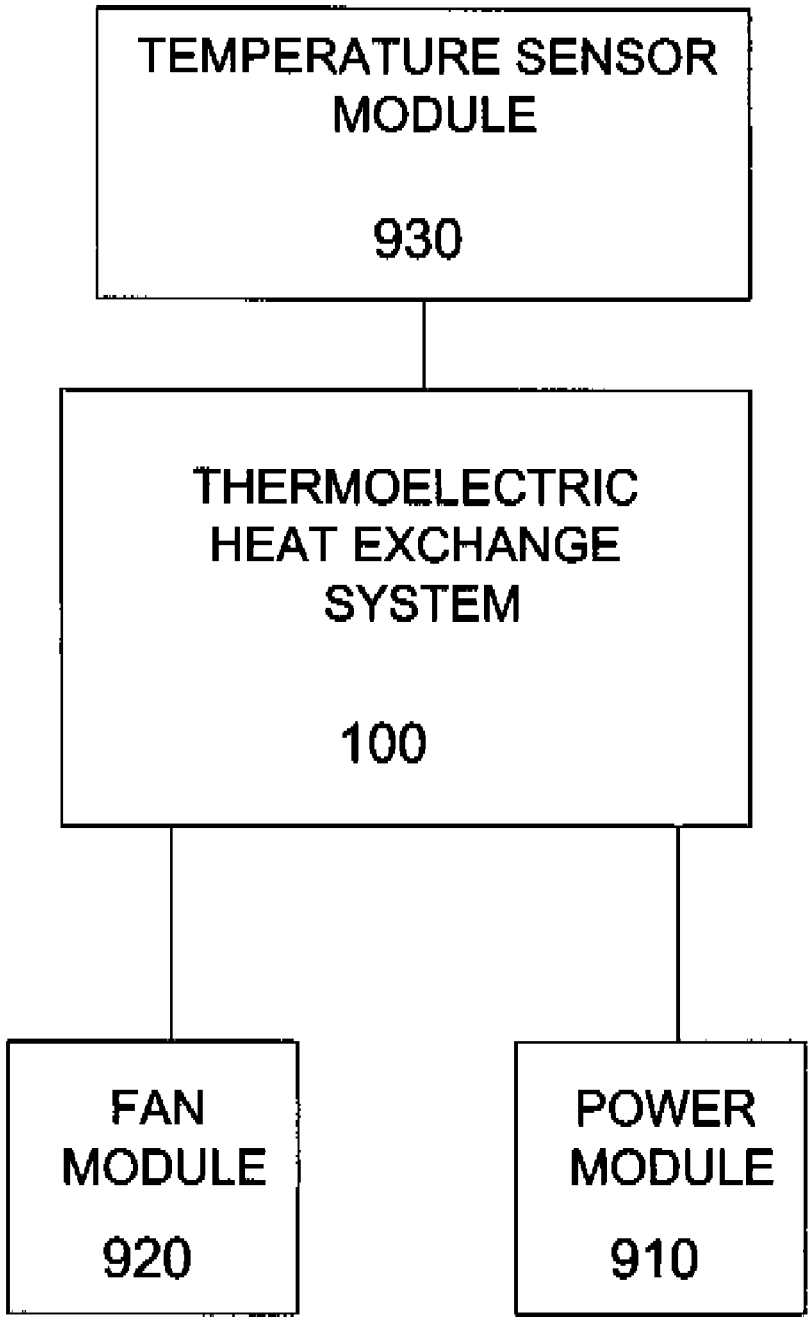
FIG. 9 is a module diagram of a thermoelectric heat exchange system according to one embodiment of the invention.

As shown in FIGS. 7 and 8, the channel system 410 may include a plurality of channels 420 internally disposed therein and oriented substantially parallel to the channel system 410, and configured to a channel fluid through the channel system 410. In being oriented substantially parallel to the channel system 410, the plurality of channels 420 may or may not extend exactly parallel to the channel system 410. The plurality of channels 420 may be created via one or more elongated members and/or fin shaped members 430. The plurality of channels 420 and/or the plurality elongated members 430 advantageously may serve to increase the velocity of the fluid flowing through the channel system 410; thereby preventing the buildup of the laminar flow. In an additional embodiment, the fin shaped and/or elongated members 430 may be composed of the same material as the heat exchange plate 150 and/or any other thermally conductive material such as, but not limited to; aluminum, steel, metal, etc.

In another embodiment, as demonstrated in FIG. 8, the fin shaped and/or elongated members 430 may be embodied as an extension of the heat exchange plate 150 and/or heat exchange plate cover 450 and/or directly and/or indirectly coupled thereto. The plurality of fin shaped members 430 may be internally disposed in the channel system 410 in the any manner completed in the art. In a non-limiting example, the fins shaped members 430 may be coupled to and/or be embodied as an extension of the heat exchange plate 150.

As shown in the figures, the heat exchange system 106 also includes one or more thermoelectric cooling modules 145, or TEC modules 145, in thermal communication with the heat exchange plate 150, 450. The TEC modules 145 may be any type and/or kind of TEC module contemplated in the art. In a non-limiting example, the TEC module 145 comprises one or more peltier junctions 145. The peltier junction 145 may be any type, kind, and/or configuration of peltier junctions contemplated in the art; such as, but not limited the model numbers Inb DT-1.2, 1.15, and 1.5 available at WATRONIX, Inc. at 8376 Samra Drive, West Hills, Calif. The one or more TEC modules 145 may be arrayed, disposed, and/or aligned in any configuration contemplated in the art. In one non-limiting example, the one or more TEC modules 145 are disposed adjacent to and/or coupled to the heat exchange plate 150, 450. In this manner, the one or more TEC modules 145 transfer heat and/or thermal energy from the fluid in the channel system 410 to the heat sink 160, fan module and/or blower module 920.

In one embodiment, the TEC modules 145 are run and/or supplied power at a lower than suggested voltage. It is believed in doing so, the one or more TEC modules 145 may be run at and/or supplied a voltage of about 14 volts whereas the suggested voltage of the one or more TEC modules 145 is about 24 volts. In being about 14 volts, the TEC module may be run and/or supplied a voltage within the range of about eight to twelve volts less than the suggested voltage of the one or more TEC modules 145. Some non-limiting examples of actual and/or supplied voltages embodied in a twenty-four volt suggested TEC module 145 may include: at least about thirteen volts, at least about thirteen point four or thirteen point five (13.4 or 13.5), at least about fourteen volts (14), at least about fourteen point five volts (14.5), and/or at least fourteen point four (14.4) volts. Voltage measuring and/or adjusting is a skill readily found and easily understood by those skilled in the art and the equipment to do so is readily available.

Additionally, as shown throughout the figures, the heat exchange system 106 includes a heat sink 160 in communication with the TEC modules 145. The heat sink 160 may function and/or be configured to dissipate heat and/or thermal energy from the TEC modules 145 and the heat exchange system 106. The heat sink 160 may be any type and/or kind of heat sink contemplated in the art. Additionally, the heat sink 160 may include any components or be composed of any type of materials contemplated in the art. In one non-limiting example, the heat sink 160 comprises a series of elongated fin members 160 composed of a thermally conductive material extending away from the TEC modules 145. An air flow 165 is passed over and through the elongated fin members 160 dissipating heat energy from the thermoelectric heat exchange system 100.

Figure 3:
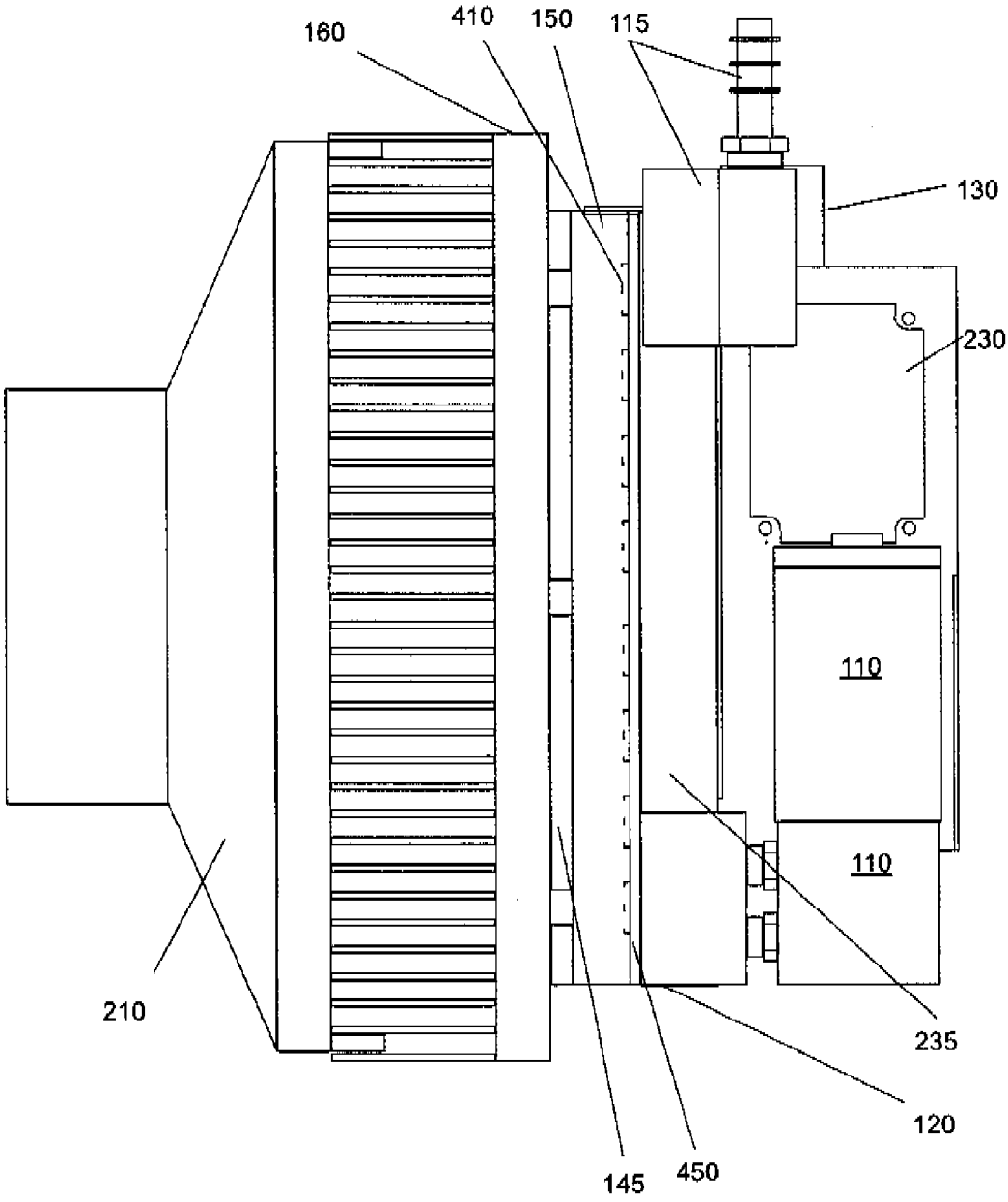
FIG. 3 is a side plan view of a thermoelectric heat exchange system according to one embodiment of the invention.
Figure 4:
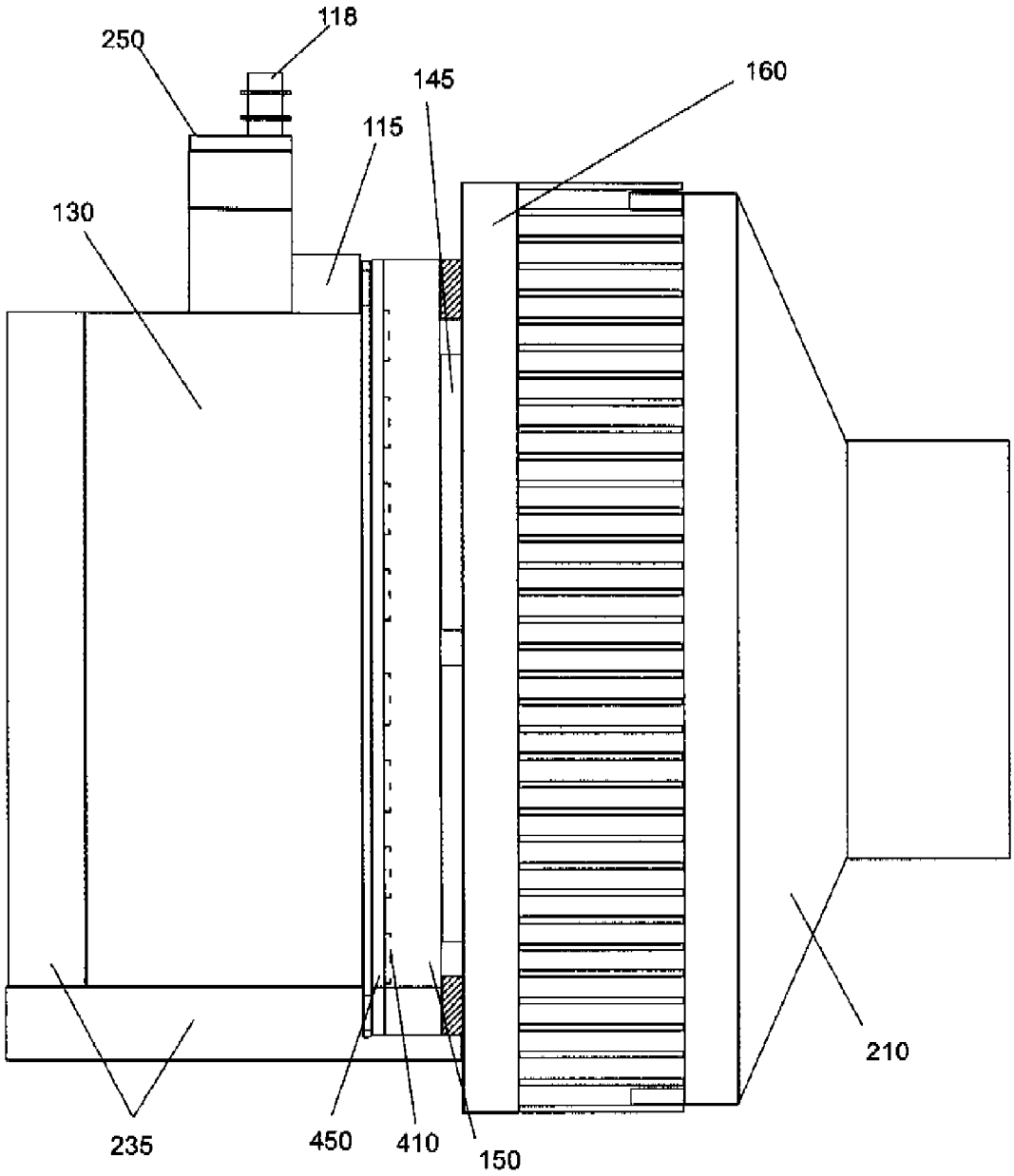
FIG. 4 is a side plan view of a thermoelectric heat exchange system according to one embodiment of the invention.
Figure 5:
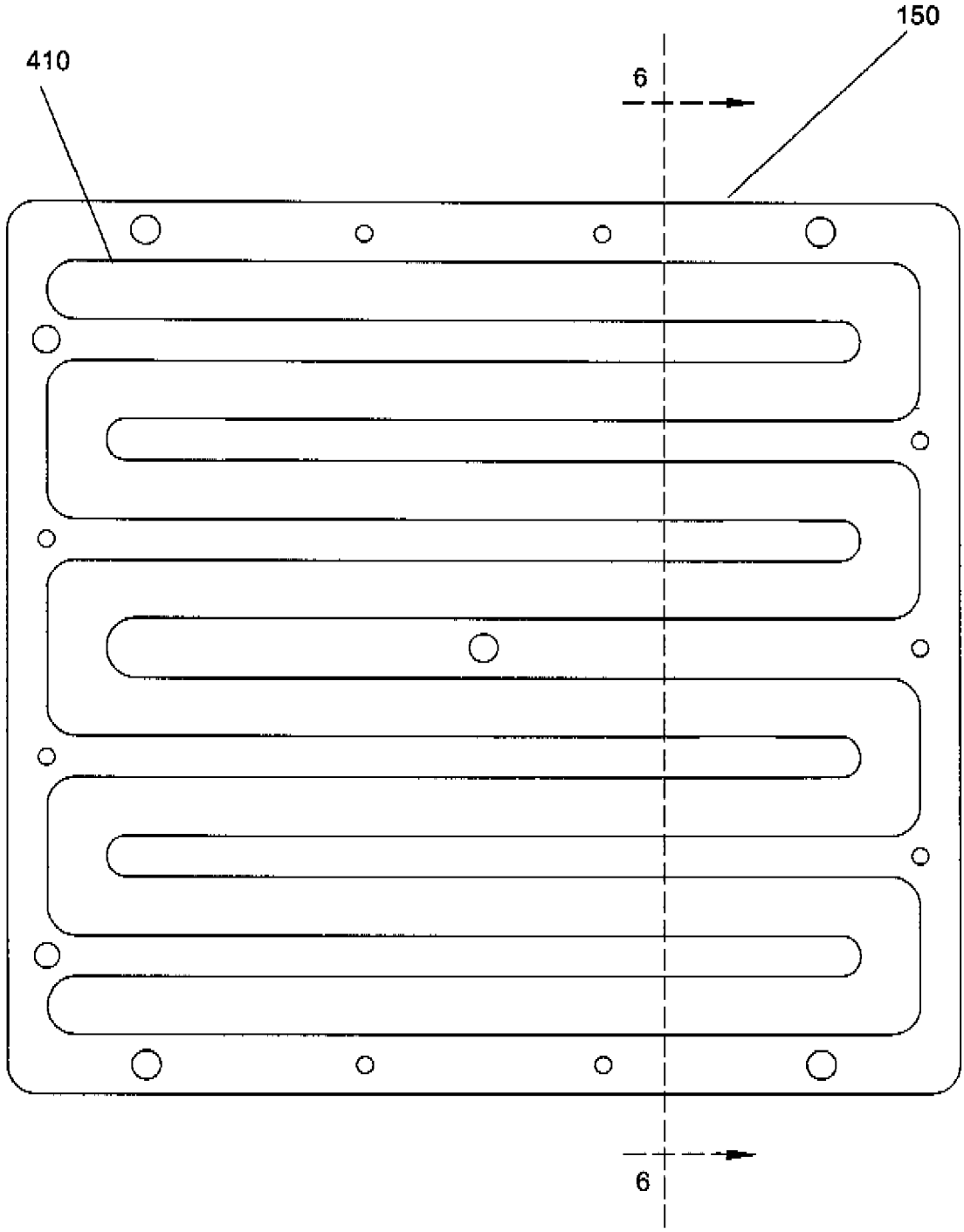
FIG. 5 is a front plan view of a heat exchange plate illustrating a longitudinal axis according to one embodiment of the invention.
Figure 6:
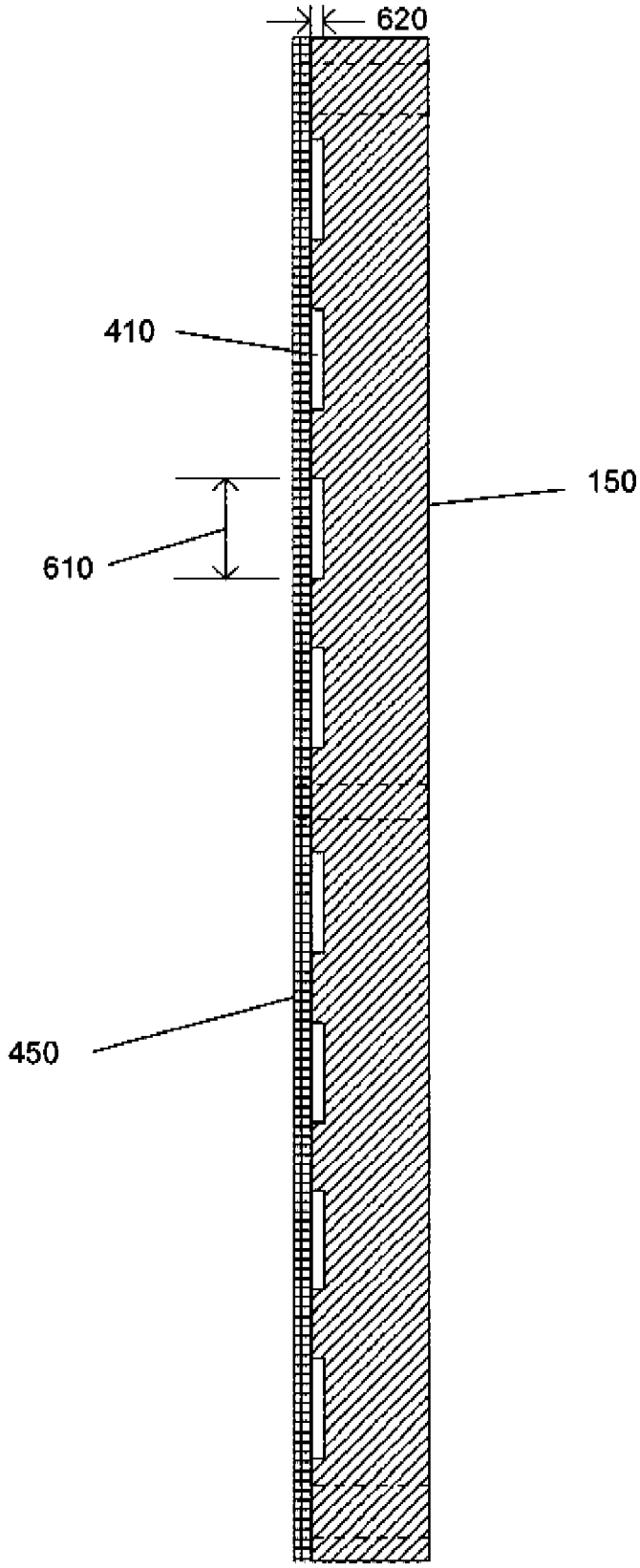
FIG. 6 is a cross sectional view of a heat exchange plate according to one embodiment of the invention.

As shown in FIGS. 3 and 4, the heat sink 160 may comprise an air-box system 210. The air-box system 210 may include any type of blower, fan, a plurality of elongated fin members and/or channels, and/or a plurality of venting holes and slits which may assist in funneling air and heat energy out of thermoelectric heat exchange system 100. The air-box system may be coupled to and/or adjacent to the heat sink 160. In an additional embodiment, a fan module 920 may be disposed internally, adjacent to, and/or in communication with the air-box system 210. The fan module 920 may be configured to pull heat energy from the heat sink 160 and TEC modules 145. Some non-limiting examples of fan modules 920 are available from ComairRotron at 8929 Terman Court, San Diego, Calif., fan modules such as the Patriot PQ24B3 E-2, PQ48C3QDN, and/or the PQ24C4.

As shown in FIG. 1, the thermoelectric heat exchange system 100 is adaptable to and/or may include a garment 135 in fluid communication with the fluid delivery system 104. In a non-limiting example, the fluid delivery system 104 comprises a tubing and/or channel system which may disposed internally and/or externally throughout the garment 135. The garment 135 may be any type of garment contemplated in the art. Some non-limiting examples of garments 135 include: shirts, coats, pants, bodysuits, undergarments, sweaters, jackets, hats, helmets, and/or so forth. In an alternative embodiment, the thermoelectric heat exchange system 100 is adaptable to any object, room, vehicle, and/or motorcycle; indeed, any object and/or area where a user desires to modify and/or control temperature.

Also shown in the figures, the thermoelectric heat exchange system 100 includes one or more temperature sensor modules 930 in communication with the heat exchange system 100, and configured to monitor and/or control the temperature of a fluid in the system 100. The one or more temperature sensors modules 930 may be incorporated and/or embodied in any of the components, hardware, systems and/or materials of the thermoelectric heat exchange system 100; and may include any type and/or kind of temperature sensor contemplated in the art. In one non-limiting example, there may be one or more temperature sensor or thermocouple modules 930 incorporated into and/or in communication with the fluid delivery system 104 the garment 135, the heat exchange system 106, the manifold 120. Temperature sensor or thermocouple modules 930 such as model number series 988, F4, and/or CPC 400 available from Watlow at Silicon Valley, Calif.

As indicated in figures, the thermoelectric heat exchange system 100 includes one or more circuit boards 230 in communication with and configured to control and/or monitor the thermoelectric heat exchange system 100. The one or more circuit boards 230 may include any components, circuitry, switches, resistors, etc. contemplated in the art. Such circuit boards 230 are readily available and/or constructable by those skilled in the art. In a non-limiting example, the one or more circuit boards comprise one more power switches which may turn on the power and/or adjustment controls. Such controls may enable a user to adjust the power levels, temperature levels, and so forth. The one or more circuit boards 230 may also include wireless transceivers and signalers, configured to enable a user to operate the thermoelectric heat exchange system 100 remotely.

Additionally, as shown in the figures, the thermoelectric heat exchange system 100 includes a power module 910 in communication with the thermoelectric heat exchange system 100 and configured to provide energy and/or power to the thermoelectric heat exchange system 100. The power module 910 may be in communication with and/or be incorporated and/or embodied in any of the components, hardware, systems and/or materials of the thermoelectric heat exchange system 100; and may include any type and/or kind of power module contemplated in the art. Some non limiting examples of power modules 910 may include: a car battery and/or alternator, portable battery system, solar panels and/or other solar power source, and/or so forth. In a non-limiting example, the power module 910 is in communication with one or more TEC modules 145, the air-box system 210, the temperature sensors, and/or the circuit boards 230, the pumping device 110, and/or so forth.

Figure 2:
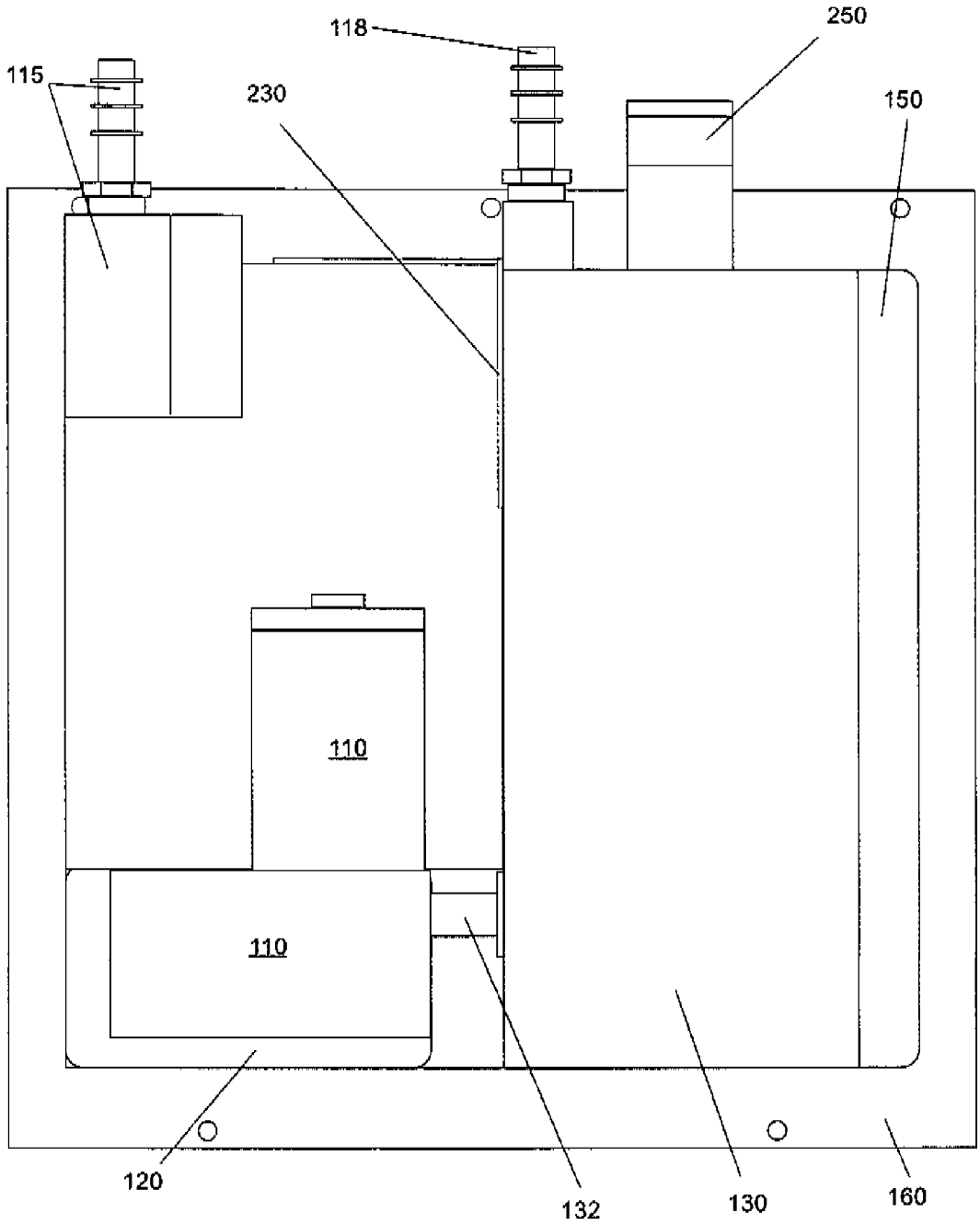
FIG. 2 is a front plan view of a thermoelectric heat exchange system according to one embodiment of the invention.

In yet another embodiment, as shown in FIGS. 2 through 4, the components of the thermoelectric heat exchange system 100 are contiguous. In being contiguous, the components of the thermoelectric heat exchange system 100 are all interconnected. Additionally, in being contiguous, the components of the thermoelectric heat exchange system 100, may all be incorporated into and be part of a manifold system and/or block 120. The manifold block and/or system 120 may provide for a more compact, easily adaptable, and more energy efficient thermoelectric heat exchange system 100. In a non-limiting example, in being contiguous, the thermoelectric heat exchange system 100 may be incorporated into the manifold block and/or system 120 through investment casting. Additionally, the investment casting process may be used to make the various components of the, such as, but not limited to, the heat exchange plate 150, 450, the manifold portions and/or block 120, and/or so forth. These components may then be coupled together to form one contiguous system.

In an additional embodiment, the manifold block and/or system 120 may comprise one or more insulated sections and/or materials 235 configured preserve energy efficiency and lessen energy loss. The insulated sections and/or materials 235 may be disposed and/or oriented in any manner contemplated in the art such that energy efficiency is maximized. In a non-limiting example, the heat exchange plate 150, 450 is sandwiched in between an insulating block and/or portion 235 and the TEC modules 145. In this manner, the heat energy exchanged from a fluid in the channel system 410 to the TEC modules 145 and heat sink 160 is maximized.

Advantageously, in one embodiment, the operation of the thermoelectric heat exchange system 100 provides an energy efficient, compact, and adaptable system for modifying and/or controlling the temperature of a person, place or object. As shown in FIG. 1, a pumping device 110 may pump a fluid from the reservoir 130 through a channel system into and through the heat exchange plate 150, 450. As the fluid travels through the channel system 410, the TEC modules 145 transfer the thermal heat energy from the fluid, causing the fluid temperature to decrease. The thermal heat energy 175 is then dissipated out of the system via the heat sink 160. The fluid delivery system 104 then circulates the cool temperature fluid 140 out the system and through a garment 135 or other area where a user desires to modify and/or control the temperature. After passing through the garment 135, the fluid 132 is circulated back through the thermoelectric heat exchange system 100.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

It is envisioned, there may be one or more pressure sensor modules and/or gauges incorporated into and/or in communication with the fluid delivery system 104 the garment 135, the heat exchange system 106, the manifold 120. Pressure sensor modules 930 such as the model FP 2000, TJE, AG400, and/or AG401 available from Honeywell, Inc. in Columbus, Ohio.

Additionally, although the figures illustrate the thermoelectric heat exchange system 100 adaptable to a garment, it is envisioned the system 100 may be adaptable for a variety of uses, and/or areas. Some non-limiting examples of objects include coolers, helmets, backpacks, and/or so forth.

It is also envisioned that the thermoelectric heat exchange system 100 may be adapted for a variety of uses. In a non-limiting example, the system 100 may be adaptable to persons traveling, working, and/or fighting in harsh climates; whether hot or cold. The system 100 may be compacted into a light-weight portable system transportable on a person's back or other body part.

Additionally, it is envisioned the size and/or dimensions of the thermoelectric heat exchange system 100 and it various components and hardware may be varied and/or suited to accommodate a variety of purposes. Some non-limiting examples include: a smaller, lighter, and/or portable version for personal transport; a medium compact size for use in the vehicles and the like; a larger, non portable size for industrial uses; and/or so forth.

It is expected that there could be numerous variations of the design of this invention. An example is that the various components and/or hardware pieces may be oriented and/or disposed in differing locations to one another.

Finally, it is envisioned that the components of the system may be constructed of a variety of materials. Some non-limiting examples include: aluminum, steel, a variety of metal alloys, titanium, polyurethane, a variety of insulating materials, and/or so forth.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A thermoelectric heat exchange system for fluids comprising:

a) a fluid delivery system including:
- a1) a pumping device, configured to deliver a fluid;
- a2) a fluid inlet system in fluid communication with the pumping device;
- a3) a fluid outlet system in fluid communication with the pumping device; and
- a4) a reservoir in fluid communication with the pumping device, and configured to hold a fluid; and b) a heat exchange system in fluid communication with the fluid delivery system, including:
- b1) a heat exchange plate in fluid communication with the fluid system, comprising a channel system including a channel; wherein a width of the channel is greater than a depth of the channel;
- b2) a thermoelectric cooling module in thermal communication with the heat exchange plate; and
- b3) a heat sink in communication with the thermoelectric cooling module, and configured to dissipate heat from the thermoelectric cooling module.

2. The thermoelectric heat exchange system of claim 1, wherein the width of the channel is at least three times greater than the depth of the channel.

3. The thermoelectric heat exchange system of claim 1, further comprising a power module in communication with the heat exchange system and the fluid delivery system, and configured to provide energy to the thermoelectric heat exchange system.

4. The thermoelectric heat exchange system of claim 1, wherein the thermoelectric cooling module comprise a peltier junction.

5. The thermoelectric heat exchange system of claim 1, wherein the peltier junction is run at a lower than suggested voltage.

6. The thermoelectric heat exchange system of claim 1, wherein the channel system comprises a plurality of fin members internally disposed in the channel and oriented substantially parallel to the channel, and configured to channel fluid through the channel system.

7. The thermoelectric heat exchange system of claim 1, further comprising a plurality of temperature sensors in thermal communication with the fluid inlet system and the fluid outlet system.

8. The thermoelectric heat exchange system of claim 1, further comprising a garment in fluid communication with the fluid delivery system.

9. The thermoelectric heat exchange system of claim 1, wherein components of the thermoelectric heat exchange system are contiguous.

10. A thermoelectric heat exchange system for fluids comprising:

a) a fluid delivery system including:
- a1) a pumping device, configured to deliver a fluid;
- a2) a fluid inlet system in fluid communication with the pumping device;
- a3) a fluid outlet system in fluid communication with the pumping device; and
- a4)a reservoir in fluid communication with the pumping device, and configured to hold a fluid; and b) a heat exchange system in fluid communication with the fluid delivery system, including:
- b1) a heat exchange plate in fluid communication with the fluid system and comprising a channel system, the channel system including a channel;
- b2) a thermoelectric cooling module in thermal communication with the heat exchange plate; and
- b3) a heat sink in communication with the thermoelectric cooling module, and configured to dissipate heat from the thermoelectric cooling module;
- b4) wherein the cross sectional area of the channel and the cross sectional area of the fluid delivery system are substantially equal.

11. The thermoelectric heat exchange system of claim 10, further comprising a power module in communication with the heat exchange system and the fluid delivery system, and configured to provide energy to the thermoelectric heat exchange system.

12. The thermoelectric heat exchange system of claim 10, wherein the heat exchange plate further comprises a channel system wherein a width of the channel is at least three times greater than a depth of the channel.

13. The thermoelectric heat exchange system of claim 12, wherein the channel system comprises a plurality of fin members internally disposed in the channel and oriented substantially parallel to the channel, and configured to channel fluid through the channel system.

14. The thermoelectric heat exchange system of claim 10, wherein the thermoelectric cooling module comprise a peltier junction.

15. The thermoelectric heat exchange system of claim 12, wherein the thermoelectric cooling module further comprises a plurality of peltier junctions.

16. The thermoelectric heat exchange system of claim 12, wherein the peltier junction is run at a lower than suggested voltage.

17. The thermoelectric heat exchange system of claim 1, further comprising a plurality of temperature sensors in thermal communication with the fluid inlet system and the fluid outlet system.

18. The thermoelectric heat exchange system of claim 1, further comprising a garment in fluid communication with the fluid delivery system.

19. The thermoelectric heat exchange system of claim 10, wherein the components of the thermoelectric heat exchange system are contiguous.

20. A thermoelectric heat exchange system comprising:

a) a reservoir, configured to contain a fluid;

b) a pumping device in fluid communication with the reservoir, and configured to pump a fluid;

c) a first fluid inlet system in fluid communication with the pumping device;

d) a first fluid outlet system in fluid communication with the pumping device;

e) a thermo-controlled mixing valve in fluid communication with the fluid outlet system and fluid inlet system;

f) a heat exchange plate in fluid communication with the pumping device, including:

f1) a second fluid inlet system, configured to bring fluid into the heat exchange plate; and f2) a second fluid outlet system, configured to bring fluid out of the heat exchange plate;

f3) a channel system including a channel, configured to channel a fluid through the heat exchange plate;

f4) wherein a width of the channel is at least three times greater than a depth of the channel;

g) a thermoelectric cooling module in thermal communication with the heat exchange plate, including a peltier junction;

h) a heat sink in communication with the thermoelectric cooling module, and configured to dissipate heat from the thermoelectric cooling module;

i) a power module, in communication with the pumping device and the thermoelectric cooling module; and j) wherein the components of the thermoelectric heat exchange system are contiguous.

* * * * *